US010873801B1

(12) United States Patent
Hsu

(10) Patent No.: US 10,873,801 B1
(45) Date of Patent: Dec. 22, 2020

(54) SPEAKER

(71) Applicants: Ampacs Corporation, Taipei (TW); Dongguan Yi Xin Electronic Technology Co., Ltd, Dongguan (CN)

(72) Inventor: Hsiu-Chen Hsu, Taipei (TW)

(73) Assignees: Ampacs Corporation, Taipei (TW); Dongguan Yi Xin Electronic Technology Co., Ltd, Dongguan (CN)

( * ) Notice: Subject to any disclaimer, the term of this patent is extended or adjusted under 35 U.S.C. 154(b) by 0 days.

(21) Appl. No.: 16/703,883

(22) Filed: Dec. 5, 2019

(30) Foreign Application Priority Data

Jul. 15, 2019 (TW) ..... 108124893 A

(51) Int. Cl.

| | |
|---|---|
| ***H04R 1/02*** | (2006.01) |
| ***H04R 1/24*** | (2006.01) |
| ***H04R 1/28*** | (2006.01) |
| ***H04R 9/02*** | (2006.01) |
| ***H04R 9/06*** | (2006.01) |

(52) U.S. Cl.
CPC ..... *H04R 1/24* (2013.01); *H04R 1/025* (2013.01); *H04R 1/288* (2013.01); *H04R 9/025* (2013.01); *H04R 9/06* (2013.01)

(58) Field of Classification Search
CPC ..... H04R 1/02
See application file for complete search history.

(56) References Cited

U.S. PATENT DOCUMENTS

| | | | | |
|---|---|---|---|---|
| 5,719,946 | A * | 2/1998 | Terauchi | H04R 9/063 181/163 |
| 6,449,376 | B1 * | 9/2002 | Beltran | H04R 7/04 381/423 |
| 6,493,452 | B1 * | 12/2002 | Koizumi | H04R 1/24 181/144 |
| 2013/0016867 | A1 * | 1/2013 | Xi | H04R 1/2811 381/374 |
| 2015/0296302 | A1 * | 10/2015 | Pircaro | H04R 9/027 381/414 |
| 2015/0350765 | A1 * | 12/2015 | David | H04R 1/1075 381/74 |
| 2017/0078810 | A1 * | 3/2017 | Lee | H04R 27/00 |
| 2020/0154209 | A1 * | 5/2020 | Dinaburg | H04R 9/06 |

* cited by examiner

*Primary Examiner* — Olisa Anwah
(74) *Attorney, Agent, or Firm* — JCIPRNET

(57) ABSTRACT

A speaker includes a casing, a first diaphragm and a second diaphragm. The casing encloses a first sound chamber and a second sound chamber independent of each other. The casing has a dividing wall, and the dividing wall blocks between the first sound chamber and the second sound chamber. The first diaphragm is disposed in the first sound chamber, the second diaphragm is disposed in the second sound chamber, and the vibration frequency of the second diaphragm is higher than the vibration frequency of the first diaphragm.

12 Claims, 3 Drawing Sheets

SPEAKER

CROSS-REFERENCE TO RELATED APPLICATION

This application claims the priority benefit of Taiwan application serial no. 108124893, filed on Jul. 15, 2019. The entirety of the above-mentioned patent application is hereby incorporated by reference herein and made a part of this specification.

BACKGROUND

Technical Field

The present disclosure relates to an acoustic device, and more particularly to a speaker.

Description of Related Art

As technology continues to advance, electronic products tend to be designed to be light and minimized, and people can use minimized electronic products such as radios or walkmans at any time anywhere. In addition, due to the increasing popularity of personal digital products such as common MP3 player, mobile phone, personal digital assistant (PDA) or notebook computer, they become indispensable for daily lives. In addition, mobile phones integrated with radio and MP3 functions have also been developed. No matter which of the above electronic products is in use, in order to allow users to listen to the sound information provided by electronic products without disturbing others, earphones have become an essential accessory for electronic products. Moreover, earphones also provide a better sound transmission for a listener, so that the listener can clearly hear and understand the content of sound, not like the transmission of sound in the air that causes the sound to be unclear. In particular, when the user is in the condition of exercising, driving, moving vigorously or a noisy environment, the transmission of sound is also not affected.

In order to allow the headphones to be compatible with medium pitch, high pitch and low pitch audio, some headphones are equipped with a high pitch diaphragm and a medium-low pitch diaphragm. However, the sound chambers of the conventional high pitch diaphragm and the medium-low pitch diaphragm are connected to each other, which causes that the high-frequency sound wave and the medium-low-frequency sound wave are affected by each other and cannot be distinguished. Moreover, this type of configuration is not easily adaptable for miniaturization of the device due to an increase in the number of components.

SUMMARY

The present disclosure provides a speaker that can distinguish between medium-low-frequency sound wave and high-frequency sound wave.

The speaker of the present disclosure includes a casing, a first diaphragm and a second diaphragm. The casing encloses a first sound chamber and a second sound chamber independent of each other. The casing has a dividing wall, and the dividing wall blocks between the first sound chamber and the second sound chamber. The first diaphragm is disposed in the first sound chamber, the second diaphragm is disposed in the second sound chamber, and the vibration frequency of the second diaphragm is higher than the vibration frequency of the first diaphragm.

In an embodiment of the disclosure, the casing includes an upper casing and a lower casing, the upper casing covers the lower casing to enclose the first sound chamber and the second sound chamber, and the dividing wall is formed on the upper casing.

In an embodiment of the disclosure, the first sound chamber surrounds the second sound chamber.

In an embodiment of the disclosure, the speaker includes a first voice coil, a second voice coil and a magnetic component, wherein the first voice coil is connected to the first diaphragm, and the second voice coil is connected to the second diaphragm, the magnetic component is disposed in the casing and corresponds to the first voice coil and the second voice coil.

In an embodiment of the disclosure, the dividing wall is connected to the magnetic component.

In an embodiment of the disclosure, the magnetic component includes a first magnetic conductive component, a second magnetic conductive component and a magnet. The first magnetic conductive component and the second magnetic conductive component are respectively connected to the opposite ends of the magnet. The first voice coil is disposed between the first magnetic conductive component and the second magnetic conductive component, and the second voice coil is disposed between the first magnetic conductive component and the second magnetic conductive component.

In an embodiment of the disclosure, the speaker includes a circuit board, wherein the circuit board is disposed on an outer surface of the casing, the magnetic component has an opening. The casing has another opening, and at least one wire is adapted to be connected to the second voice coil and pass through the openings to be connected to the circuit board.

In an embodiment of the disclosure, the casing has a plurality of venting holes, and the venting holes respectively communicate with the first sound chamber and the second sound chamber.

In an embodiment of the disclosure, the speaker includes a plurality of dampers that cover the venting holes.

In an embodiment of the disclosure, an outer surface of the casing has a recess, and a microphone is adapted to be disposed in the recess.

In an embodiment of the disclosure, the outer surface of the casing has a groove, the groove is connected with the recess, and a wire is adapted to be connected to the microphone and arranged along the groove.

In an embodiment of the disclosure, the first diaphragm and the second diaphragm do not overlap each other in the axial direction of the speaker.

Based on the above, in the speaker of the present disclosure, the first sound chamber corresponding to the first diaphragm (for example, the medium-low pitch diaphragm) and the second sound chamber corresponding to the second diaphragm (for example, the high pitch diaphragm) are independent of each other without communication through the isolation of the dividing wall of the casing, so as to prevent that the sound wave generated by the first diaphragm and the sound wave generated by the second diaphragm affect each other in the sound chamber. In this manner, the speaker can generate a bass medium-low pitch sound and also generate a clear high pitch sound.

In order to make the aforementioned features and advantages of the disclosure more comprehensible, embodiments accompanying figures are described in detail below.

DESCRIPTION OF THE EMBODIMENTS

Figure 1:
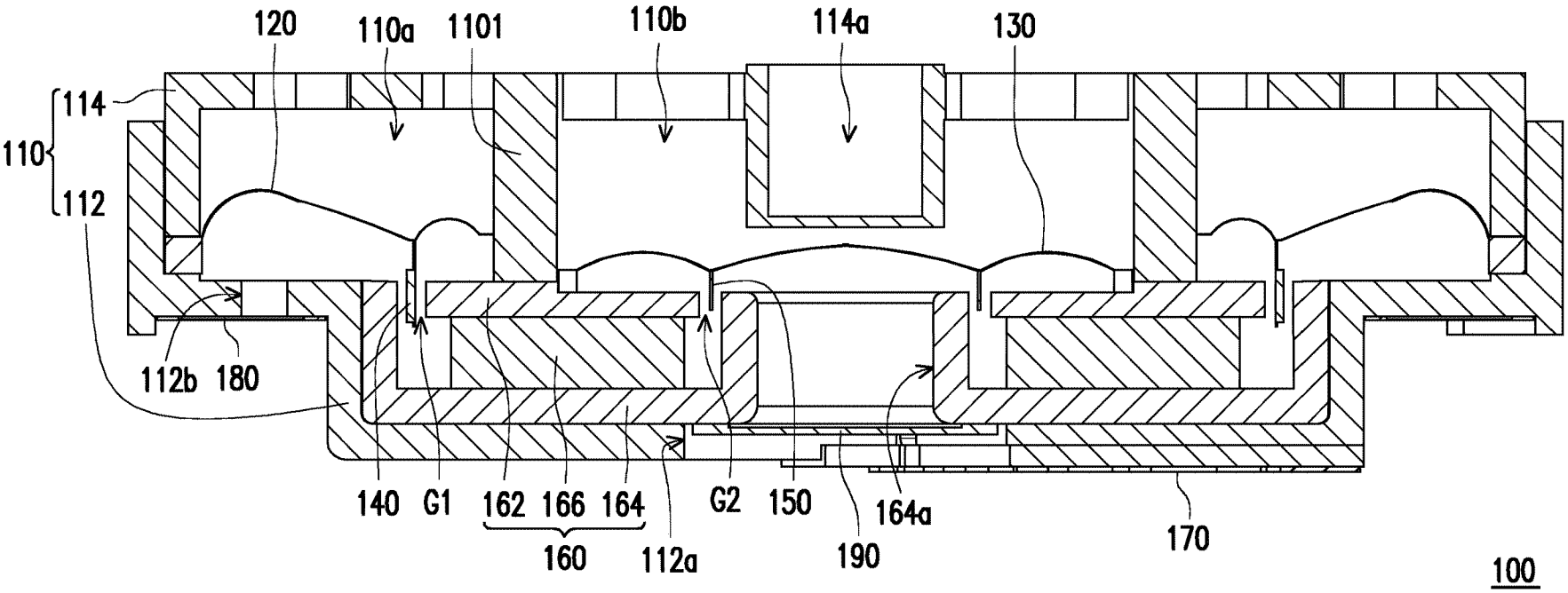
FIG. 1 is a cross-sectional view of a speaker according to an embodiment of the present disclosure.
Figure 2:
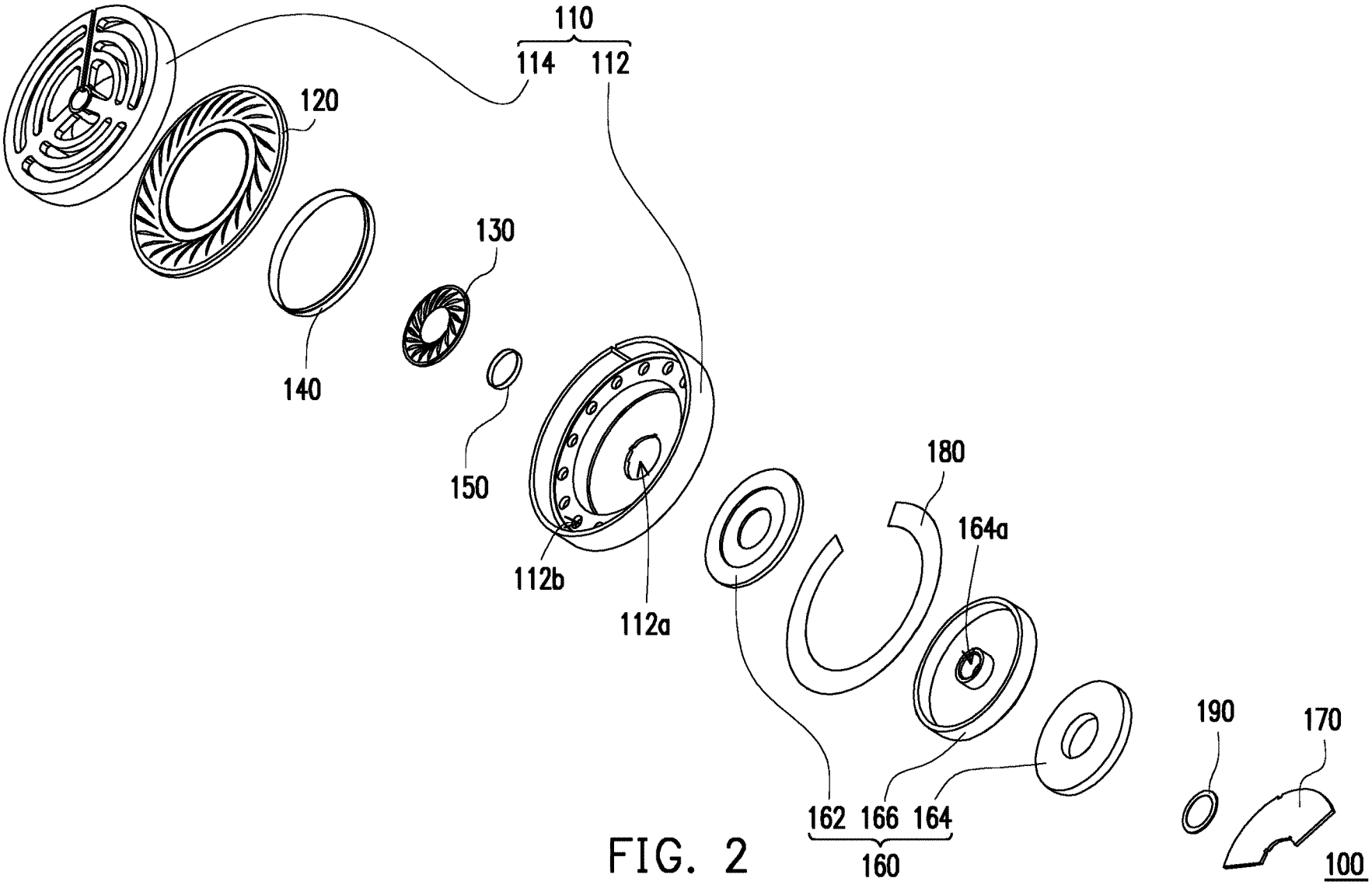
FIG. 2 is an exploded view of the speaker of FIG. 1.

FIG. 1 is a cross-sectional view of a speaker according to an embodiment of the present disclosure. FIG. 2 is an exploded view of the speaker of FIG. 1. Referring to FIG. 1 and FIG. 2, a speaker 100 of the present embodiment is applied to earphones, for example, and includes a casing 110, a first diaphragm 120, and a second diaphragm 130. The casing 110 encloses a first sound chamber 110*a* and a second sound chamber 110*b* which are independent of each other. Specifically, the casing 110 has a dividing wall 1101, and the dividing wall 1101 is, for example, an annular shape and blocks between the first sound chamber 110*a* and the second sound chamber 110*b*. The first diaphragm 120 is disposed in the first sound chamber 110*a*, and the second diaphragm 130 is disposed in the second sound chamber 110*b*. The first diaphragm has, for example, a large area and is made of a material having low rigidity to be a medium-low pitch diaphragm, and the second diaphragm 130 has, for example, a small area and is made of a material having high rigidity to be a high pitch diaphragm. That is, the vibration frequency of the second diaphragm 130 is higher than the vibration frequency of the first diaphragm 120.

With this configuration, the first sound chamber 110*a* corresponding to the first diaphragm 120 (for example, a medium-low pitch diaphragm) and the second sound chamber 110*b* corresponding to the second diaphragm 130 (for example, a high pitch diaphragm) are independent of each other in the speaker 100 through the isolation of the dividing wall 1101 of the casing 110, so as to prevent that the sound wave generated by the first diaphragm 120 and the sound wave generated by the second diaphragm 130 affect each other in the sound chamber. In this manner, the speaker 100 can generate a bass medium-low pitch sound through the first diaphragm 120 and also generate a clear high pitch sound through the second diaphragm 130.

In the present embodiment, the casing 110 includes an upper casing 114 and a lower casing 112. The upper casing 114 covers the lower casing 112 to enclose the first sound chamber 110*a* and the second sound chamber 110*b* between the upper casing 114 and the lower casing 112. The dividing wall 1101 is formed, for example, on the upper casing 114, but the disclosure is not limited thereto. In other embodiments, the dividing wall 1101 may be formed on the lower casing 112. In the present embodiment, the upper casing 114 and the lower casing 112 are combined, for example, in a glued manner, but the present disclosure provides no limitation to the manner in which the upper casing 114 and the lower casing 112 are assembled.

In order to save the configuration space, in the embodiment, the first sound chamber 110*a* is disposed to surround the second sound chamber 110*b*, so that the first diaphragm 120 in the first sound chamber 110*a* and the second diaphragm 130 in the second sound chamber 110 is roughly arranged on the same plane in a coaxial manner and do not overlap each other in the axial direction of the speaker 100 without excessively increasing the thickness of the speaker 100.

Further, the speaker 100 of the embodiment further includes a first voice coil 140, a second voice coil 150 and a magnetic component 160. The first voice coil 140 is connected to the first diaphragm 120, the second voice coil 150 is connected to the second diaphragm 130, and the magnetic component 160 is disposed in the casing 110 and corresponds to the first voice coil 140 and the second voice coil 150. Specifically, the magnetic component 160 includes a first magnetic conductive component 162, a second magnetic conductive component 164 and a magnet 166. The first magnetic conductive component 162 is, for example, a magnetic conductive plate, the second magnetic conductive component 164 is, for example, magnetic steel, and the magnet 166 is, for example, a permanent magnet. The first magnetic conductive component 162 and the second magnetic conductive component 164 are respectively connected to opposite ends of the magnet 166, and the second magnetic conductive component 164 is placed in the lower casing 112 and carries and houses the magnet 166 and the second magnetic conductive component 164. The center of the first magnetic conductive component 162 is slightly concaved to arrange the second diaphragm 130. A gap G1 is formed between the peripheral structure of the second magnetic conductive component 164 and the first magnetic conductive component 162, and the first voice coil 140 extends into the gap G1 and thus located between the first magnetic conductive component 162 and the second magnetic conductive component 164. A gap G2 is formed between the central structure of the second magnetic conductive component 164 and the first magnetic conductive component 162, and the second voice coil 150 extends into the gap G2 and thus located between the first magnetic conductive component 162 and the second magnetic conductive component 164.

When the first voice coil 140 receives an input signal to be actuated by the magnetic field provided by the magnetic component 160, the first diaphragm 120 is driven by the first voice coil 140 to vibrate, thereby generating a corresponding medium-low frequency sound wave. Similarly, when the second voice coil 150 receives the input signal to be actuated by the magnetic field provided by the magnetic component 160, the second diaphragm 130 is driven by the second voice coil 150 to vibrate, thereby generating a corresponding high frequency sound wave. By making the first voice coil 140 and the second voice coil 150 to share the magnetic component 160 as described above, the number of components of the speaker 100 can be reduced to save configuration space.

In the present embodiment, the dividing wall 1101 abuts against the magnetic component 160 to practically separate the first sound chamber 110*a* from the second sound chamber 110*b* so they are independent of each other. In other embodiments, the first sound chamber 110*a* and the second sound chamber 110*b* may be separated by other suitable structures and manners, the present disclosure provides no limitation thereto.

The electrical connection method of the speaker 100 of the present embodiment is described as follows. The speaker 100 includes a circuit board 170, and the circuit board 170 is, for example, a terminal connection board and is disposed on an outer surface of the lower casing 112 of the casing 110. The second magnetic conductive component 164 of the magnetic component 160 has an opening 164*a*. The lower casing 112 of the casing 110 has another opening 112*a*, a wire (not shown) for transmitting the input signal to the second voice coil 150 may be connected to the second voice coil 150 and pass through the opening 164*a* and the opening 112*a* along the axial direction of the speaker 100 to be connected to the circuit board 170. On the other hand, a wire (not shown) for transmitting the input signal to the first voice coil 140 may extend from the lateral periphery of the casing 110 to the circuit board 170.

In the embodiment, the lower casing 112 of the casing 110 has a plurality of venting holes 112*b*, and the opening 112*a* may also be regarded as the venting hole, and the venting holes respectively communicate with the first sound chamber 110*a* and the second sound chamber 110*b*. The speaker 100 further includes dampers 180 and 190 corresponding to the venting holes, and the dampers 180 and 190 cover the venting holes.

Figure 3:
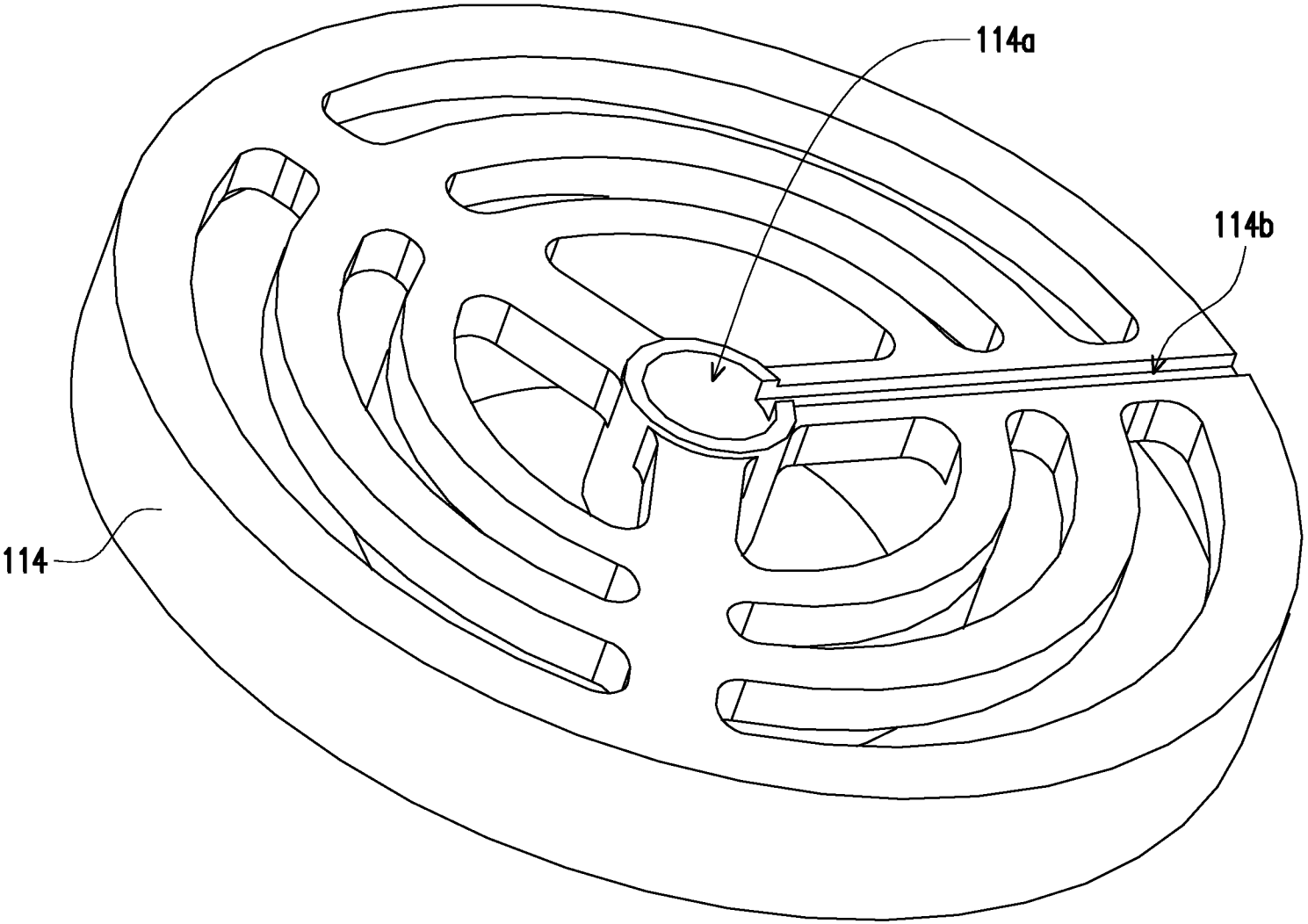
FIG. 3 is an enlarged view of the upper casing of FIG. 2.

FIG. 3 is an enlarged view of the upper casing of FIG. 2. Referring to FIG. 3, in the embodiment, the outer surface of the upper casing 114 of the casing 110 (shown in FIG. 2) has a recess 114*a* and a groove 114*b* connected to each other. A microphone (not shown) may be disposed in the recess 114*a*, and a wire (not shown) is connected to the microphone and configured along the groove 114*b* to be connected to the audio noise reduction processing unit outside the speaker 100. In this manner, the audio noise reduction processing unit can perform audio noise reduction according to the sound outputted by the speaker 100 and received by the microphone, so as to further improve the sound output quality of the speaker 100.

In summary, in the speaker of the present disclosure, the first sound chamber corresponding to the first diaphragm (for example, the medium-low pitch diaphragm) and the second sound chamber corresponding to the second diaphragm (for example, the high pitch diaphragm) are independent of each other without communication through the isolation of the dividing wall of the casing, so as to prevent that the sound wave generated by the first diaphragm and the sound wave generated by the second diaphragm affect each other in the sound chamber. In this manner, the speaker can generate a bass medium-low pitch sound and also generate a clear high pitch sound. Furthermore, the first voice coil and the second voice coil can share the magnetic component, thereby reducing the number of components of the speaker to save configuration space.

Although the present disclosure has been disclosed in the above embodiments, it is not intended to limit the present disclosure, and those skilled in the art can make some modifications and refinements without departing from the spirit and scope of the disclosure. Therefore, the scope to be protected by the present disclosure is subject to the scope defined by the appended claims.

What is claimed is:

1. A speaker, comprising:

a casing, enclosing a first sound chamber and a second sound chamber independent of each other, wherein the casing has a dividing wall, the dividing wall blocks between the first sound chamber and the second sound chamber;

a first diaphragm, disposed in the first sound chamber; and a second diaphragm, disposed in the second sound chamber, wherein a vibration frequency of the second diaphragm is higher than a vibration frequency of the first diaphragm.

2. The speaker of claim 1, wherein the casing comprises an upper casing and a lower casing, the upper casing covers the lower casing to enclose the first sound chamber and the second sound chamber, the dividing wall is formed on the upper casing.

3. The speaker of claim 1, wherein the first sound chamber surrounds the second sound chamber.

4. The speaker of claim 1, comprising a first voice coil, a second voice coil and a magnetic component, wherein the first voice coil is connected to the first diaphragm, the second voice coil is connected to the second diaphragm, the magnetic component is disposed in the casing and corresponds to the first voice coil and the second voice coil.

5. The speaker of claim 4, wherein the dividing wall is connected to the magnetic component.

6. The speaker according to claim 4, wherein the magnetic component comprises a first magnetic conductive component, a second magnetic conductive component and a magnet, wherein the first magnetic conductive component and the second magnetic conductive component are respectively connected to opposite ends of the magnet, the first voice coil is disposed between the first magnetic conductive component and the second magnetic conductive component, and the second voice coil is disposed between the first magnetic conductive component and the second magnetic conductive component.

7. The speaker of claim 4, comprising a circuit board, wherein the circuit board is disposed on an outer surface of the casing, the magnetic component has an opening, and the casing has another opening, at least one wire is adapted to be connected to the second voice coil and pass through the openings to be connected to the circuit board.

8. The speaker of claim 1, wherein the casing has a plurality of venting holes, the venting holes respectively communicate with the first sound chamber and the second sound chamber.

9. The speaker of claim 8, comprising a plurality of dampers covering the venting holes.

10. The speaker of claim 1, wherein an outer surface of the casing has a recess, and a microphone is adapted to be disposed in the recess.

11. The speaker of claim 10, wherein the outer surface of the casing has a groove, the groove is connected to the recess, and a wire is adapted to be connected to the microphone and disposed along the groove.

12. The speaker of claim 1, wherein the first diaphragm and the second diaphragm do not overlap each other in an axial direction of the speaker.

* * * * *